US007451909B2

(12) United States Patent
Sexton

(10) Patent No.: US 7,451,909 B2
(45) Date of Patent: Nov. 18, 2008

(54) PACKAGING ARRANGEMENT

(75) Inventor: Mark D. Sexton, Minneapolis, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 659 days.

(21) Appl. No.: 11/151,866

(22) Filed: Jun. 13, 2005

(65) Prior Publication Data

US 2006/0278687 A1 Dec. 14, 2006

(51) Int. Cl.

| | |
|---|---|
| ***B42D 15/00*** | (2006.01) |
| ***B65D 27/04*** | (2006.01) |
| ***B65D 5/00*** | (2006.01) |
| ***G09F 1/00*** | (2006.01) |
| ***G09F 3/18*** | (2006.01) |

(52) U.S. Cl. ..... 229/92.8; 229/71; 229/128; 40/124.06; 40/649

(58) Field of Classification Search ..... 229/128, 229/300, 92.8, 84, 906, 71; 40/649, 124.01, 40/124.06, 124.07

See application file for complete search history.

(56) References Cited

U.S. PATENT DOCUMENTS

| | | | | |
|---|---|---|---|---|
| 883,352 | A * | 3/1908 | Simon | 229/92.8 |
| 2,335,115 | A * | 11/1943 | Gresser | 229/308 |
| 2,898,257 | A * | 8/1959 | Carver | 156/289 |
| 2,964,227 | A | 12/1960 | Goldsholl | |
| 3,010,571 | A | 11/1961 | Transport | |
| 3,126,145 | A | 3/1964 | Struble | |
| 3,190,541 | A * | 6/1965 | McLaughlin et al. | 229/92.8 |
| 3,773,251 | A * | 11/1973 | Hadick | 229/92.8 |
| 3,894,755 | A * | 7/1975 | Cieslak et al. | 283/116 |
| 3,899,127 | A * | 8/1975 | Melander | 229/303 |
| D250,171 | S | 11/1978 | Yoshimoto | |
| 4,375,482 | A | 3/1983 | Maroszek et al. | |
| 4,852,794 | A * | 8/1989 | Bennett et al. | 229/301 |
| 5,004,271 | A * | 4/1991 | Piatt | 283/65 |
| 5,911,358 | A | 6/1999 | Kenner et al. | |
| 5,934,469 | A | 8/1999 | Gould | |
| D438,105 | S | 2/2001 | Conner et al. | |
| 6,719,128 | B2 | 4/2004 | Alpern et al. | |
| 6,719,189 | B1 * | 4/2004 | Malerba | 229/92.8 |
| 2006/0000127 | A1 * | 1/2006 | Schindele | 40/124.06 |

* cited by examiner

*Primary Examiner*—Jes F Pascua
(74) *Attorney, Agent, or Firm*—Merchant & Gould P.C.

(57) ABSTRACT

A packaging arrangement for marketing products and information; the packaging arrangement including an envelope, a sleeve, and a postcard. Each of the sleeve and the postcard being positionable within a volume defined by the envelope. The postcard including a tab that is located outside of the volume of the envelope when the postcard is positioned within the envelope. The sleeve including a front floating panel and a back panel designed and arranged to create visual illusions and provide various visual effects.

39 Claims, 4 Drawing Sheets

PACKAGING ARRANGEMENT

TECHNICAL FIELD

This disclosure relates generally to a packaging arrangement. More particularly, this disclosure relates to a packaging arrangement for use in advertising or marketing information and/or products.

BACKGROUND

A wide variety of marketing arrangements are utilized for packaging and displaying informational material. Informational material includes printed text, graphics, and sample products, for example. As can be understood, a consumer's interest in the informational material can be influenced by the packaging of the informational material. The likelihood that a potential consumer will take time to review and consider the contents of the packaging often depends upon whether or not the packaging sparks the interest of the consumer.

In the marketing and advertising business, cost associated with circulating and distributing packaged informational material can be significant. Also, providing creative and interesting marketing arrangements of packaged informational material for distribution in large quantities requires that the arrangements be durable enough for mass mailings and transit, for example.

In general, what is needed is a packaging arrangement that is cost-effective for purposes of marketing and advertising, is durable enough for mass mailing and transit, and provides a unique design that persuades a potential consumer to further investigate the contents of the packaging.

SUMMARY

One aspect of the present disclosure relates to a packaging arrangement including an envelope, a sleeve, and a postcard. The sleeve is positioned within a volume of the envelope and includes a back panel and a front panel. The front panel is located within a central region of the volume of the envelope when the sleeve is positioned within the envelope. The postcard is positioned behind the back panel of the sleeve and within the volume of the envelope. The postcard includes a tab located outside the volume of the envelope when the postcard is positioned within the envelope.

Another aspect of the present invention relates to a method of assembling a packaging arrangement. The method includes inserting a sleeve into a volume of an envelope and sliding a postcard behind a back panel of the sleeve. The method further includes enclosing the envelope so that a folding portion and a tab of the postcard are located outside the volume of the envelope.

Still another aspect of the present invention relates to a method of using a packaging arrangement. The method includes providing a packaging arrangement having an envelope, a sleeve positioned within a volume of the envelope, and a postcard having a main portion and a tab. The main portion of the postcard being positioned within the volume of the envelope, and the tab being positioned outside the volume of the envelope. The method further includes pulling the tab of the postcard and sliding the main portion of the postcard out from the volume of the envelope without opening the envelope.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

FIGS. 1-7 illustrate a packaging arrangement 10 having features that are examples of how inventive aspects in accordance with the principles of the present disclosure may be practiced. Preferred features are adapted for providing a durable mailing construction that catches a recipient's eye to promote further investigation into the contents of the packaging arrangement.

Figure 1:
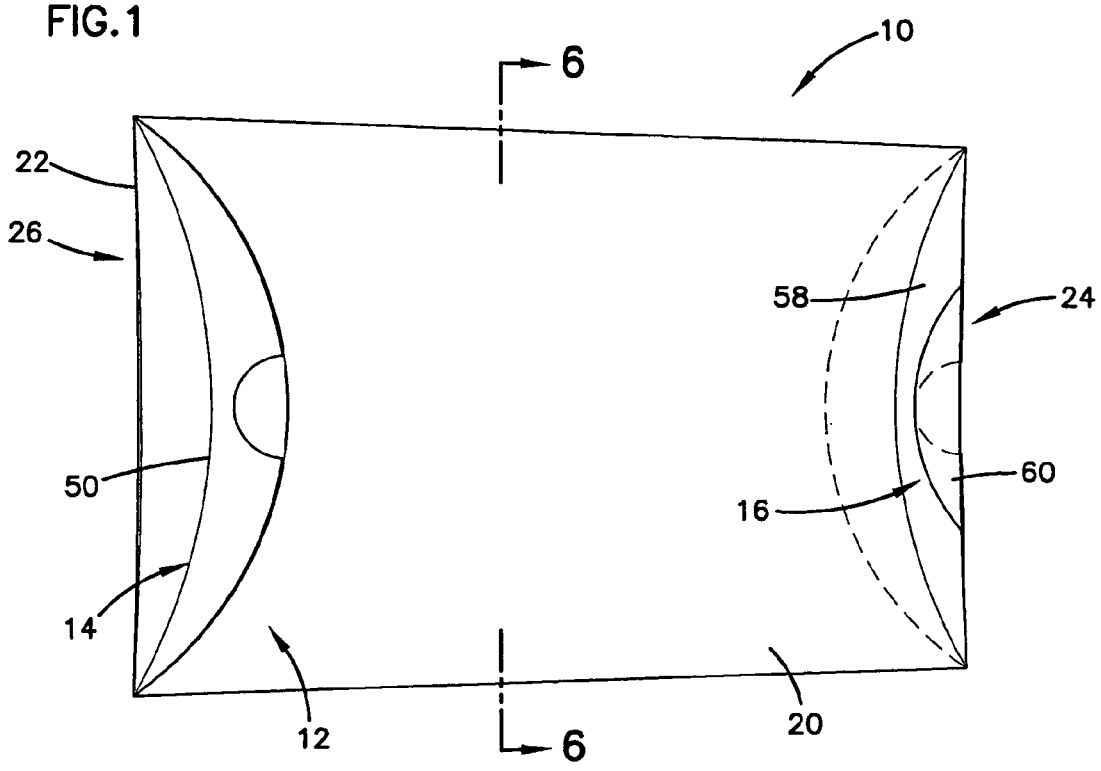
FIG. 1 is a perspective view of a packaging arrangement according to the principles of the present disclosure.
Figure 2:
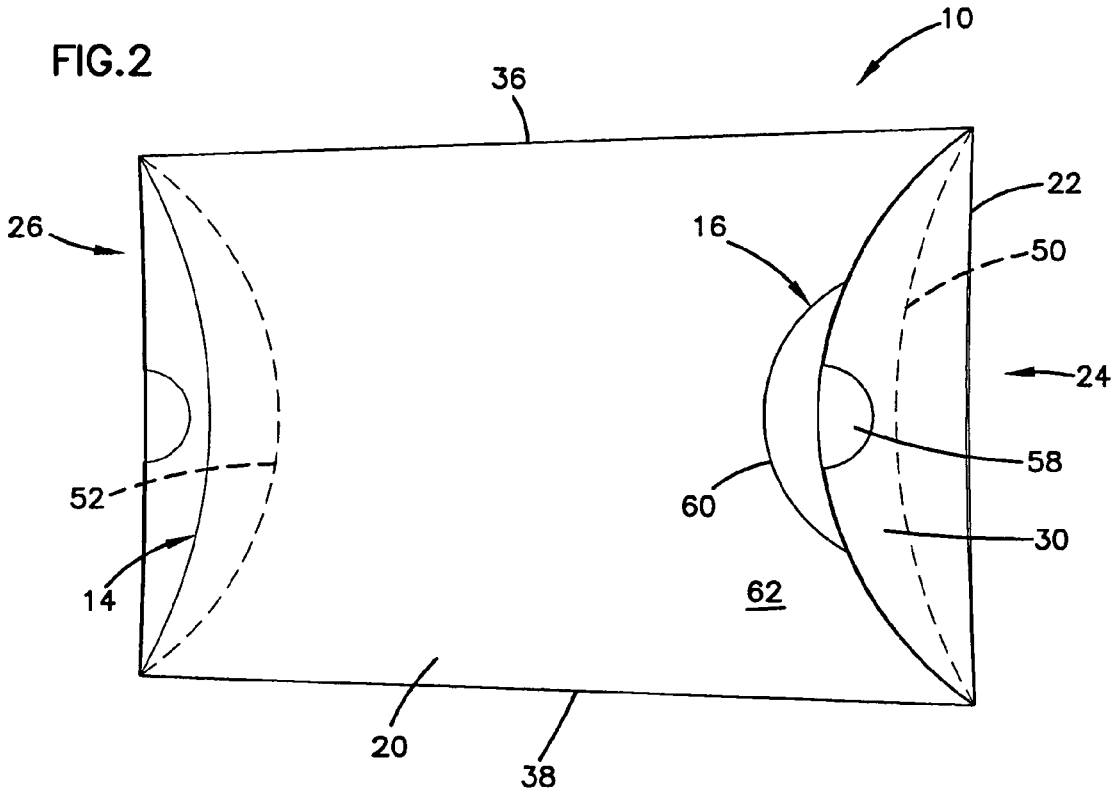
FIG. 2 is another perspective view of the packaging arrangement of FIG. 1.

Referring to FIGS. 1 and 2, the packaging arrangement 10 includes an envelope or outer shell 12. The envelope 12 is preferably made of a clear material so that the content of the envelope 12 can be viewed without having to open the envelope 12. In one embodiment, the envelope 12 is made of box-grade clear rigid vinyl having a thickness of about 20 millimeters. Alternative types of materials having a different thickness or other transparent or non-transparent qualities can also be used in accord with the disclosed principles.

Figure 3:
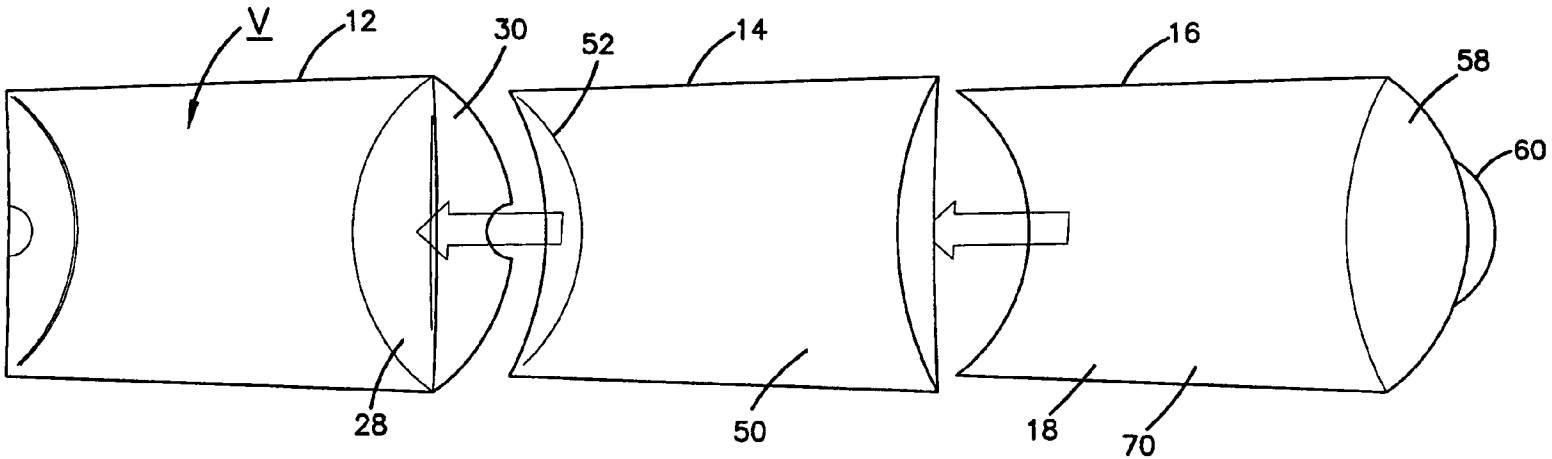
FIG. 3 is an exploded perspective view of the packaging arrangement of FIG. 1.
Figure 4:
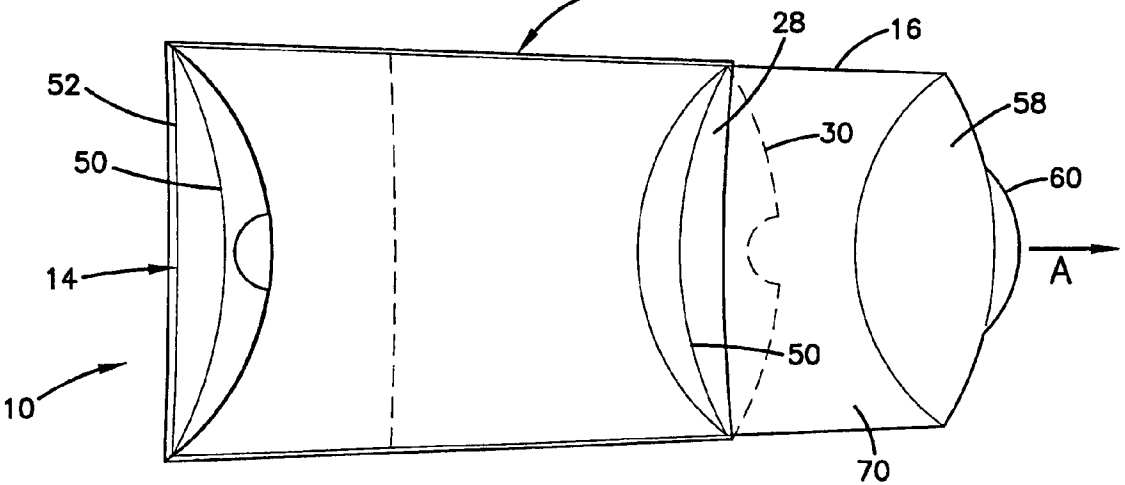
FIG. 4 is a perspective view of the packaging arrangement of FIG. 1, shown with a sliding postcard partially removed.

Referring also now to FIG. 3, the packaging arrangement 10 further includes a sleeve 14 and a postcard 16. The sleeve 14 and the postcard 16 are positionable within an interior volume V of the envelope 12. Each of the envelope 12, the sleeve 14, and the postcard 16 are designed to provide an interesting, eye-catching presentation of informational material to a recipient. What is meant by informational material is printed information such as text and graphics, and sample products, for example.

In use, the packaging arrangement 10 can be used as a direct mailer. That is, the packaging arrangement is sized and designed to be directly deposited in the U.S. mail, without any additional packaging or wrap. Postage, for example, can be printed on the postcard 16 located within the envelope 12, and viewable through the clear material of the envelope 12. In the alternative, a postage label can be placed directed on the envelope 12. In other uses, the packaging arrangement 10 can be used as a sample handout or advertising souvenir.

Figure 5:
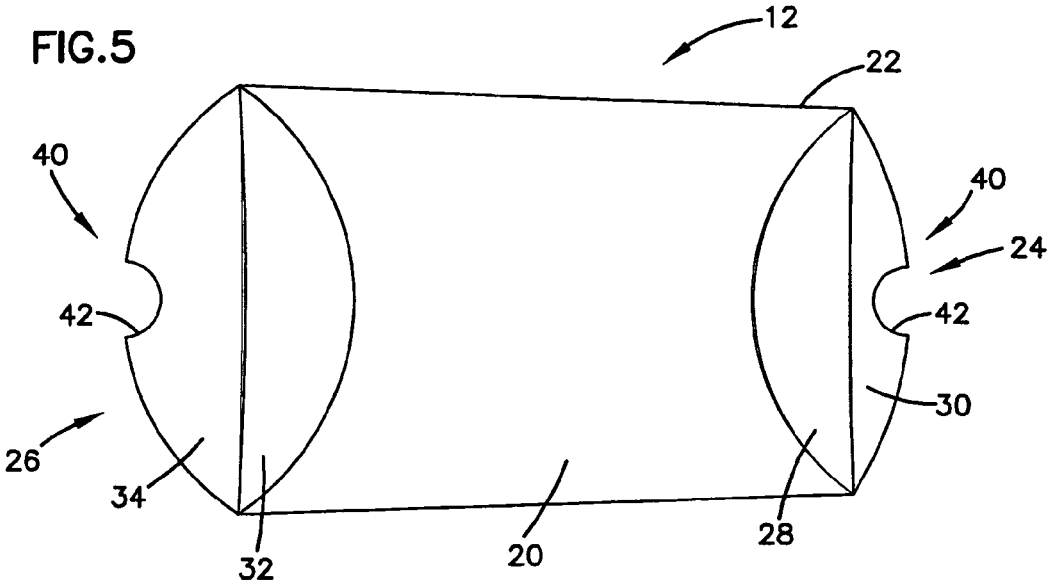
FIG. 5 is a perspective view of an envelope of the packaging arrangement of FIG. 3.

Still referring to FIGS. 1 and 2, the envelope 12 of the packaging arrangement 10 has a front wall 20 and a back wall 22 that extend between a first end 24 and a second end 26 of the envelope 12. As shown in FIG. 5, the first and second ends 24, 26 are defined by foldable side flaps. In particular, each of the front and back walls 20, 22 includes first side flaps 28, 30 and second side flaps 32, 34. The first and second side flaps 28, 30, 32, 34 are creased so that the flaps can be opened and closed. In the illustrated embodiment of FIG. 5, the first and second side flaps 30, 34 of the back wall 22 are opened, and the first and second side flaps 28, 32 of the front wall 20 are closed.

When assembled, the first side flaps 28, 30 and second side flaps 32, 34 fold over one another at each of the ends 24, 26 to enclose the envelope 12. The front wall 20, the back wall 22, and the side flaps 28, 30, 32, 34 define the volume V of the envelope 12 within which each of the sleeve 14 and postcard 16 are positioned. As will be discussed in greater detail hereinafter, the volume V of the envelope 12 is designed to not only strike the curiosity of a recipient, but to also provide a space for displaying or arranging information or sample products.

Figure 6:
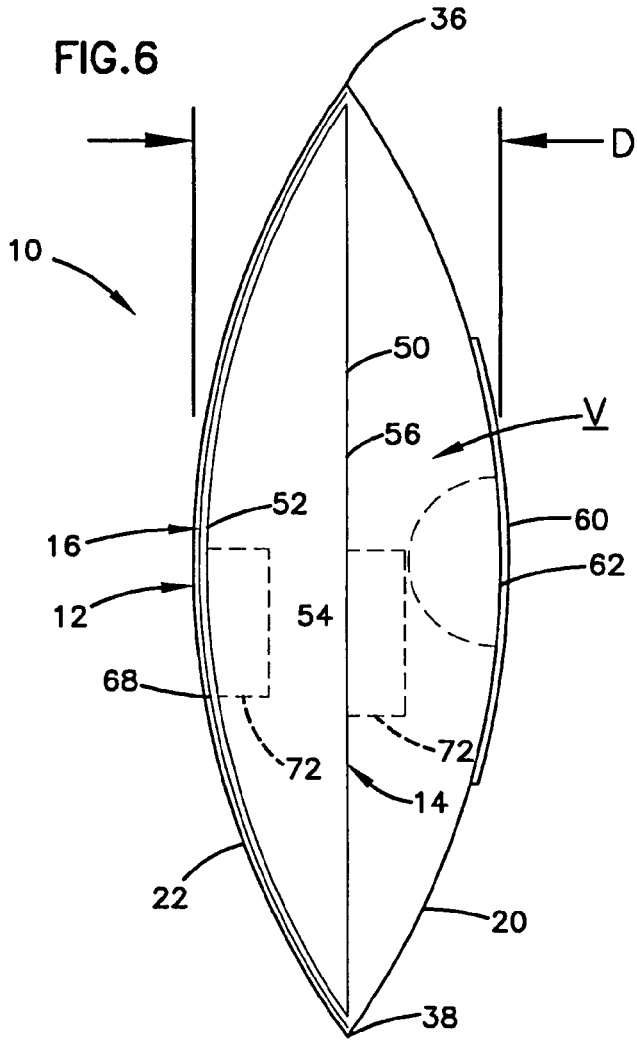
FIG. 6 is a cross-sectional view of the packaging arrangement of FIG. 1, taken along lines 6-6.
Figure 7:
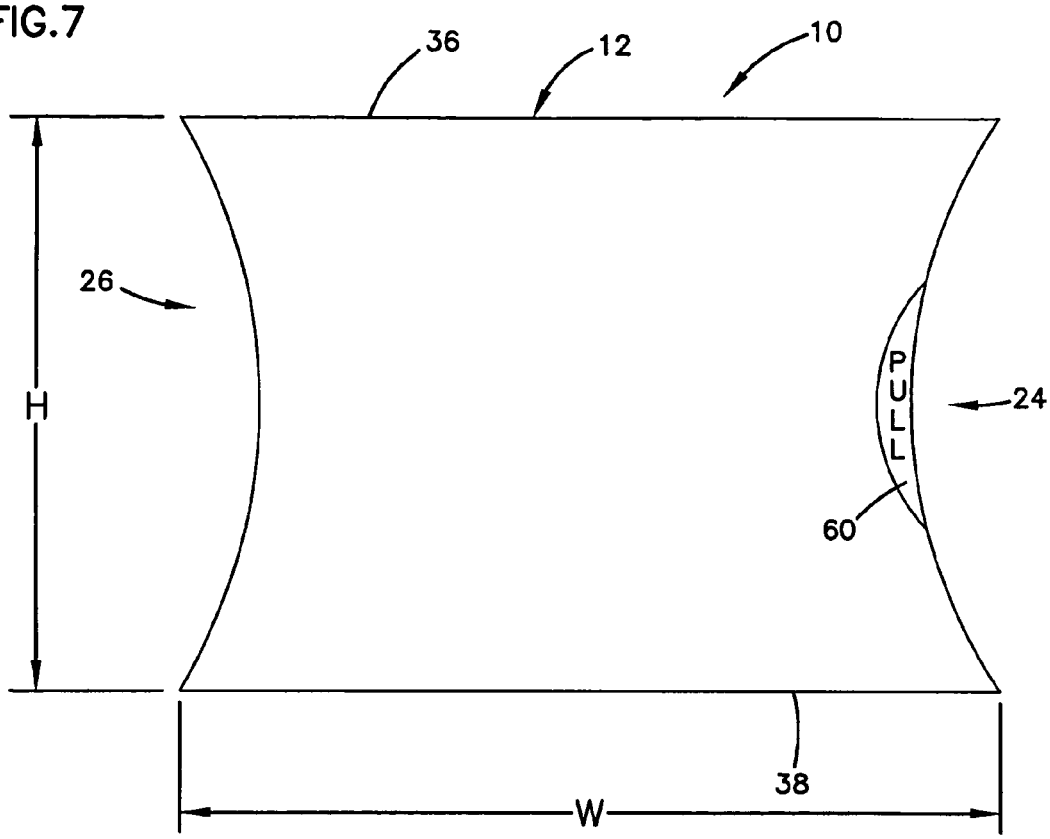
FIG. 7 is a front elevation view of the packaging arrangement of FIG. 1.

Referring now to FIGS. 6 and 7, the volume of the envelope 12 is generally defined by a width W, a height H, and a depth D; although the disclosed principles can be applied to provide a variety of sized and shaped envelope configurations. The width W (FIG. 7) of the envelope is generally defined between the first and second ends 24, 26 of the envelope 12, and is preferably between 4.0 and 20.0 inches; more preferably between 6.0 and 16.0 inches. The height H of the envelope is generally defined between a top edge 36 and a bottom edge 38, and is preferably between 3.0 and 12.0 inches; more preferably between 4.0 and 9.0 inches. The depth D (FIG. 6) of the envelope is generally defined as the maximum distance between the front and back walls 20, 22, and is preferably between 0.75 and 4.0 inches; more preferably between 1.0 and 3.0 inches. The volume V associated with the various dimensions of the envelope 12 is typically between about 40 and 325 cubic inches.

Referring to FIG. 6, the front and back walls 20, 22 of the envelope 12 have a convex curvature. As shown in FIG. 7, the first and second ends 24, 26 of the envelope, defined by the side flaps 28, 30, 32, 34, have a concave curvature. The particular structural features of the envelope 12 are not only aesthetically eye-catching, but also contribute to the durability of the overall envelope construction. For example, the foldable side flaps of the concave ends 24, 26 provide structural support to the overall envelope construction so that the volume V of the packaging arrangement 10 is maintained during transit and handling, for example.

Referring again to FIG. 5, the ends 24, 26 of the envelope 12 can include indicia structure 40 that indicates to the recipient that the side flap should be opened to access the content of the envelope 12. For example, the foldable side flaps can include indicia structure 40 that permit the recipient to easily open the flaps to access the volume V of the envelope. In the illustrated embodiment, the indicia structure is a thumb notch 42 formed in the first and second side flaps 30, 34 of the back wall 22.

Referring now to FIGS. 3 and 6, the sleeve 14 of the packaging arrangement 10 is sized to fit within the volume V of the envelope 12. The sleeve 14 includes a front floating panel 50 and a back panel 52. As shown in FIG. 6, when the sleeve 14 is positioned within the envelope 12, the front floating panel 50 is located within a central region 54 of the volume V of the envelope 12.

The back panel 52 of the sleeve 14 has a convex curvature that corresponds to the convex curvature of the back wall 22 of the envelope 12. Unlike the back panel 52, the front panel 50 has a generally planar surface 56. The planar surface 56 extends from the top edge 36 of the envelope 12 to the bottom edge 38 of the envelope 12. The planar surface 56 of the front panel 50 divides the volume V and is spaced a distance from each of the front and back walls 20, 22 of the envelope 12. The construction of the sleeve 14 provides the illusion that the front panel 50 is floating within the interior volume V of the envelope 12.

The front floating panel 50 is preferably a non-opaque or transparent construction so that the recipient can see through the front floating panel. In one embodiment, the front panel 50 is made of a transparent sheet of material, such as box-grade clear rigid vinyl. The back panel 52 is typically an opaque construction displaying graphics or informational print. The back panel 52 can be made of a laminated paper or cardboard construction; in one embodiment, the laminate has a thickness of approximately 0.005 inches, for example. In another embodiment, the front panel 50 and the back panel 52 can be made of one piece of folded clear rigid vinyl, with the front panel remaining clear and the back panel being visually opaque through the use of 4-color printing, for example. Other embodiments can include front and back panels made of other materials in accord with the principles disclosed.

In the illustrated embodiment, the front floating panel 50 of the sleeve 14 is adhered or glued to the back panel 52 adjacent to top and bottom edges 64, 66 of the back panel 52. So that the shape of the back panel 52 of the sleeve 14 corresponds to the shape of the envelope 12, the front panel 50 is adhered tautly to the top and bottom edges 64, 66 of the back panel 52. The tautness of the front panel 50 causes the back panel 52 to bend and provides the convex curvature of the back panel 52.

Many visual effects can be created with the use of the front floating panel 50 of the sleeve 14. For example, in one embodiment, the back panel 52 has a first opaque color that transitions into a second opaque color. The front floating panel 50 has a first non-opaque color that transitions into a second non-opaque color. The location of the first and second opaque colors and the first and second non-opaque colors interact to provide three-dimensional imagery. Informational material, such as text or graphics, can be printed directly on the front and back panels 50, 52 to add further visual interest and effect. The sleeve 14 of the present packaging arrangement 10 combines imagery from the back panel 52 and the front floating panel 50 to create visual illusions and provide various visual effects not possible without the front floating panel 50.

As shown in FIG. 3, the sleeve 14 is sized and configured to slide into and out from the volume V of the envelope 12. In some embodiments, informational material, such as an article or sample product 72 (shown schematically by dashed lines in FIG. 6), can be placed within the volume V of the envelope 12. The sample product 72 can be secured to the back panel 52 or secured to and held in the central region 54 of the volume V by the front floating panel 50. In embodiments where the product 72 is secure to one of the panels of the sleeve 14, a recipient can simply open the foldable side flaps of the envelope 12 and slide the sleeve 14 out from the volume V of the envelope to access the sample product 72.

Still referring to FIG. 3, the postcard 16 is also positionable within the volume V of the envelope 12. In the illustrated embodiment, a main portion 18 of the postcard 16 fits behind the back panel 52 of the sleeve 14. The postcard 16 includes a folding portion 58 and a tab 69 located at an end of the main portion 18 of the postcard 16. When the postcard 16 is positioned within the envelope 12, the folding portion 58 and the tab 60 are located outside of the volume V of the envelope 12.

The postcard 16 is sized and configured to slide into and out from the volume V of the envelope 12. Preferably, the packaging arrangement 10 is constructed such that the sliding postcard 16 can be pulled out of the volume V of the envelope 12 by the folding portion 58 without completely opening either of the first and second ends 24, 26 of the envelope 12.

In particular, when assembled as shown in FIG. 2, the folding portion 58 of the sliding postcard 16 is positioned between the first side flaps 28, 30 of the front and back walls 20, 22 at the first end 24 of the envelope 12. The tab 60 extends outward from the side flaps 28, 30 so that a recipient can grasp the tab 60, and pull or slide the postcard 16 out from the volume V of the envelope 12. When the recipient grasps and pulls the tab 60, the first side flap 30 of the back wall 22 opens (FIG. 4) and the postcard 16 slides out from behind the back panel 52 of the sleeve 14. The first side flap 28 of the front wall 20 does not open, but rather remains closed until manually opened by the recipient.

With the packaging arrangement 10, the recipient is provided first with information shown on the postcard 16. The recipient can then access the interior volume V if desired by opening the first side flap 28 of the front wall 20.

The packaging arrangement 10 is assembled by inserting the sleeve 14 into the volume V of the envelope 12. When inserted, the front floating panel 50 is located in the central region 54 of the envelope 12. Typically visual graphics are provided on both the front floating panel 50 and the back panel 52 of the sleeve. As previously described, a sample product 72 can also be secured either to the front or back panels 50, 52 of the sleeve 14. The sample product 72 can be secured to either panel by conventional fasteners, or more preferably, a removable adhesive, such as fugitive glue, so that the sample product can be easily removed from the panel 50, 52.

The postcard 16 is slid into the volume V of the envelope 12 behind the back panel 52 of the sleeve 14. The second end 26 of the envelope 12 is closed by folding the second side flaps 32, 34 over one another. The first side flap of the front wall 20 is folded over to close the first end 24 of the envelope 12. The folding portion 58 and the tab 60 of the postcard 16 are now located outside of the volume V of the envelope 12. The folding portion 58, and the first side flap 30 of the back wall 22 are then folded over the first side flap 28 of the front wall 20. When the first side flaps 28, 30 of the first end 24 are thereby folded, the tab 60 of the postcard 16 extends outward from the first side flaps 28, 30.

The side flaps at each of the ends 24, 26 of the envelope 12 can be sealed or secured with an easily removable adhesive, such as fugitive glue. In addition, the tab 60 of the postcard 16 can be similarly secured or adhered so that the tab is not inadvertently pulled during mailing and transport. In the illustrated embodiment, the tab 60 is wrapped around the first end 24 of the envelope 12 and secured to an exterior surface 62 of the front wall 20.

In the alternative, the side flaps at each of the ends 24, 26 of the envelope 12, and the postcard tab 60, can be secured by perforated wafer stickers. For example, a wafer sticker can be adhered to each of the first and second side flaps 30, 34 of the back wall and to the exterior surface 62 of the front wall 20 to seal the ends 24, 26 of the envelope 12. Likewise, a wafer sticker can be adhered to the tab 60 and the exterior surface 62 of the front wall 20 to secure the tab.

As previously described, the packaging arrangement 10 is preferably sized and constructed so that the arrangement can be placed directly in the mail, without additional packaging or wrap. Eliminating the need for additional packaging or wrap reduces costs associated with distributing or circulating the informational material to potential consumers. The recipient's address, and postage, can be printed on a backside 68 (FIG. 6) of the postcard 16. Because the envelope is transparent, the backside 68 of the postcard 16 can be view through the back wall 22 of the envelope 12. In the alternative, a label can be placed directed on the exterior surface of the back wall 22 of the envelope 12.

To open the packaging arrangement, the recipient grasps the tab 60 of the postcard 16 and pulls on the tab in an outward, lateral direction (as shown by arrow A in FIG. 4) from the first side 24 of the envelope 12. Referring to FIG. 7, instructions can be printed on the tab 60 directing the recipient to pull on the tab 60. As the tab 60 is being pulled, the first side flap 30 of the back wall 22 opens and the postcard 16 then slides out from behind the sleeve 14 to reveal information printed on a front side 70 (FIG. 4) the postcard 16. The functional arrangement between the postcard 16 and the envelope 12 makes the present packaging arrangement 10 an effective marketing tool by immediately focusing the recipient on the marketing and informational content of the postcard 16, as well as providing an easy and convenient way to open the envelope 12.

The packaging arrangement 10 of the present disclosure provides a cost-effective marketing and packaging arrangement by eliminating excess costs associated with additional packaging or wrap. The packaging arrangement 10 also is durable in mass mailing and transit, and provides a unique design that sparks the interest the recipient and persuades the recipient to further investigate the information or sample product contained within the envelope.

The above specification provides a complete description of the invention. Since many embodiments of the invention can be made without departing from the spirit and scope of the invention, certain aspects of the invention reside in the claims hereinafter appended.

What is claimed is:

1. A packaging arrangement, comprising:

a) an envelope defining a volume;

b) a sleeve positioned within the volume of the envelope, the sleeve including a back panel and a front panel, the front panel being located within a central region of the volume of the envelope when the sleeve is positioned within the envelope; and c) a postcard positioned behind the back panel of the sleeve within the volume of the envelope, the postcard including a main portion and a tab, the tab being located outside the volume of the envelope when the main portion of the postcard is positioned within the envelope.

2. The arrangement of claim 1, wherein the postcard can be pulled out from the volume of the envelope by the tab without opening either of a first end or a second end of the envelope.

3. The arrangement of claim 2, wherein each of the first and second ends of the envelope is defined by side flaps that open and close, and wherein at least one of the side flaps remains closed when the postcard is pulled out from the volume of the envelope.

4. The arrangement of claim 1, wherein the front panel is a non-opaque construction.

5. The arrangement of claim 4, wherein the back panel is an opaque construction.

6. The arrangement of claim 5, wherein the back panel has a first opaque color that transitions into a second opaque color, and wherein the front panel has a first non-opaque color that transitions into a second non-opaque color, the location of the first and second opaque colors and the first and second non-opaque colors providing three-dimensional imagery.

7. The arrangement of claim 1, wherein the volume of the envelope is between about 40 and 325 cubic inches.

8. The arrangement of claim 1, wherein the volume of the envelope is defined by front and back walls and side flaps located at first and second ends of the envelope.

9. The arrangement of claim 8, wherein the each of the front and back walls includes first and second side flaps that fold over one another.

10. The arrangement of claim 9, wherein at least one of the first and second side flaps of at least one of the front and back walls includes indicia structure to indicate that the side flap can be opened to access the content of the envelope.

11. The arrangement of claim 10, wherein the indicia structure is a thumb notch formed in the at least one side flap of the envelope.

12. The arrangement of claim 8, wherein a folding portion of the postcard is positioned between the first side flaps of the front and back walls at the first end of the envelope.

13. The arrangement of claim 12, wherein the tab of the postcard extends out from the side flaps so that a recipient can grasp the tab to pull the postcard out from the volume of the envelope.

14. The arrangement of claim 8, wherein the front and back walls of the envelope have a convex curvature.

15. The arrangement of claim 14, wherein the first and second ends of the envelope have a concave curvature.

16. The arrangement of claim 14, wherein the back panel of the sleeve has a convex curvature corresponding to the convex curvature of the back wall of the envelope.

17. The arrangement of claim 16, wherein the front panel is planar.

18. The arrangement of claim 1, wherein the sleeve is size and configured to slide into and out from the volume of the envelope.

19. The arrangement of claim 18, further including a sample product secured to the sleeve, the sample product being accessible by sliding the sleeve out from the volume of the envelope.

20. The arrangement of claim 1, wherein the envelope is sized for direct mailing without additional packaging or wrap.

21. A method of assembling a packaging arrangement, the method comprising the steps of:

a) providing an envelope having a volume, the envelope having a first end and a second end;

b) inserting a sleeve into the volume of the envelope, the sleeve including a back panel and a front panel, the front panel being located in a central region of the volume when the sleeve is inserted into the volume;

c) sliding a postcard into the volume of the envelope behind the back panel, the postcard including a folding portion and a tab; and d) enclosing the volume of the envelope by closing side flaps located at the first and second ends of the envelope, the folding portion and the tab of the postcard being located outside the volume of the envelope when the first and second ends of the envelope are enclosed.

22. The method of claim 21, further including the step of placing an article within the volume of the envelope.

23. The method of claim 21, further including providing informational material on at least one of the postcard and the sleeve.

24. The method of claim 23, wherein the step of providing informational material includes securing an article to the front panel of the sleeve.

25. The method of claim 23, wherein the step of providing informational material includes providing printed information on the postcard.

26. The method of claim 23, wherein the step of providing informational material includes providing printed graphics on at least one of the front panel and the back panel of the sleeve.

27. The method of claim 21, wherein the step of enclosing the volume of the envelope includes positioning the folding portion of the postcard between the side flaps such that the tab extends outward from the side flaps.

28. The method of claim 21, further including the step of securing the tab of the postcard to an exterior surface of the envelope.

29. The method of claim 28, wherein the step of securing the tab includes adhering the tab to the exterior surface with a removable adhesive.

30. The method of claim 21, wherein the step of providing an envelope includes providing an envelope sized and constructed to be directly mailed without additional packaging or wrap.

31. A method of using a packaging arrangement, the method comprising the steps of:

a) providing a packaging arrangement, the arrangement including:

i) an envelope having a volume;

ii) a sleeve positioned within the volume of the envelope; and iii) a postcard having a main portion and a tab, the main portion of the postcard being positioned within the volume of the envelope, the tab being positioned outside the volume of the envelope; and b) pulling the tab of the postcard and sliding the main portion of the postcard out from the volume of the envelope without opening the envelope.

32. The method of claim 31, wherein the step of providing the packaging arrangement includes providing a sleeve having a back panel and a front panel, the front panel being located in a central region of the volume.

33. The method of claim 32, wherein the step of sliding the main portion of the postcard out from the volume of the envelope includes sliding the main portion out from behind the back panel of the sleeve.

34. The method of claim 31, wherein the step of providing the packaging arrangement includes providing an envelope having side flaps located at each of a first end and a second end of the envelope.

35. The method of claim 34, wherein the step of pulling the tab includes opening a first side flap located at the first end of the envelope.

36. The method of claim 35, further including the step of opening a second side flap at the first end to access the volume of the envelope.

37. The method of claim 36, further including sliding the sleeve out from the volume of the envelope, through the opened first end of the envelope.

38. The method of claim 37, further including detaching an article from the sleeve of the packing arrangement.

39. The method of claim 31, further including the step of detaching the tab of the postcard from an exterior surface of the envelope before pulling the tab.

* * * * *